United States Patent [19]

Tarui et al.

[11] Patent Number: 4,753,691

[45] Date of Patent: Jun. 28, 1988

[54] METHOD OF DIRECTLY SOFTENING ROLLED MACHINE STRUCTURAL STEELS

[75] Inventors: Toshimi Tarui; Toshihiko Takahashi, both of Sagamihara; Hiroshi Sato, Kamaishi, all of Japan

[73] Assignee: Nippon Steel Corporation, Tokyo, Japan

[21] Appl. No.: 18,575

[22] Filed: Feb. 25, 1987

[30] Foreign Application Priority Data

Feb. 25, 1986 [JP] Japan ..... 61-39665

[51] Int. Cl.[4] ..... C21D 8/00

[52] U.S. Cl. ..... 148/12 R; 148/12 D

[58] Field of Search ..... 148/12 R, 12 B, 12 D, 148/12 F

[56] References Cited

U.S. PATENT DOCUMENTS 3,285,789 11/1966 Grange et al. ..... 148/12 R
3,423,252 1/1969 Grange ..... 148/12 R

FOREIGN PATENT DOCUMENTS 55-65323 5/1980 Japan .
58-107416 6/1983 Japan .

*Primary Examiner*—Wayland Stallard
*Attorney, Agent, or Firm*—Wenderoth, Lind & Ponack

[57] ABSTRACT

A method of directly softening a rolled machine structural steel is provided. This method is characterized by the fact that it comprises the steps of:

hot rolling a steel consisting essentially of 0.2–0.65% C, less than 0.1% Si, 0.2–0.5% Mn, 0.0003–0.01% B, more than 0.5–1.7% Cr, 0.01–0.1% Al, all of the percentages being on a weight basis, and the balance being Fe and incidental impurities, and may contain one or more other alloying elements selected from either one of or both of groups (A) and (B), group (A) consisting of not more than 1% Ni, 0.1–0.5% Mo and not more than 1% Cu, and the other group (B) consisting of 0.002–0.05% Ti, 0.005–0.05% Nb and 0.005–0.2% V, then subjecting said rolled steel to either one of the two softening treatments (1) or (2), the treatment (1) comprises slowly cooling the steel in a temperature range until transformation to pearlite is completed at a cooling rate of less than 15° C./min, and the treatment (2) comprises, isothermally holding said steel in a temperature range of 680° to 730° C. until the transformation to pearlite is completed and then to natural cooling, so that the steel can display a tensile strength less than a value expressed by a formula, $24+67\times Ceq$ (kg/mm$^2$), specified by the carbon equivalent Ceq (kg/mm$^2$) of the subject steel.

8 Claims, 1 Drawing Sheet

METHOD OF DIRECTLY SOFTENING ROLLED MACHINE STRUCTURAL STEELS

BACKGROUND OF THE INVENTION

1. Field of the Invention

The present invention relates to a method of directly softening rolled machine structural steels, particularly those which are to be worked into bolts, or the like shapes by cold forging.

2. Prior Art

Heretofore, when producing machine parts from machine structural steels by cold forging, the steels have been customarily subjected to spheroidization annealing of cementite prior to cold forging, with an intention of softening them, or reducing their resistance to deformation. Since this softening treatment takes as long as 10–20 hours, it has long been desired to develop a soft rolled steel that does not need any such spheroidization annealing, from the viewpoint of achieving improved productivity or reduced energy consumption.

While various proposals have been made in an attempt to attain this object, for instance, "Tetsu to Hagane (Iron and Steel)", 70, 5, 236, 1984 proposes, on the premise, that such medium carbon machine structural steels specified in the currently effective JIS (e.g. S45C and SCM435) are to be used and that the steel should be softened by rolling at low temperatures near 675° C. followed by isothermal holding of them at a specified temperature. This method, however, is not considered a satisfactory solution because such rolling in the low temperature range will cause surface defects in wires or reduced durability of working rolls.

There exist much patents literature proposing techniques for elimination of spheroidization annealing. Laid-Open Japanese Patent Publication No. 107416/1983 shows a softening method wherein a steel is rough-rolled to achieve a reduction in thickness of 30% or more at a temperature not lower than 1,000° C., then finish-rolled to achieve further reduction in thickness of 50% or more in the temperature range of from 750° to 1,000° C. and, thereafter, is cooled to the completion of transformation at a cooling rate not faster thatn 1° C./sec. Lain-Open Japanese Patent Publication No. 13024/1984 discloses a spheroidizing technique of carbides wherein a steel is finish-rolled to achieve a reduction in thickness of 30% or more in a temperature range between a point not higher than the $Ar_1$ point and one not lower than the $Ar_1$ point minus 50° C. and then the rolled steel is reheated in the temperature range of $Ac_1$–$Ac_3$. Laid-Open Japanese Patent Publication Nos. 126720 and 126721/1984 disclose a carbide spheroidizing technique, wherein a steel is finish-rolled to achieve a reduction in thickness of 80% or more in a temperature range between a value not higher than the $Ar_1$ point and the point not lower than the $Ar_1$ minus 50° C. and the subsequent rolling operation is then finished either at a temperature in the range of $Ac_1$–$Ac_3$ by using the heat resulting from rolling, or the rolled steel is immediately cooled to produce the structure of spheroidized carbide. Laid-Open Japanese Patent Publication Nos. 136421, 136422 and 136423/1984 propose a carbide spheroidizing technique wherein a steel is finish-rolled to achieve a reduction in thickness of 10% or more in a temperature range between a value not higher than $Ar_1$ and one not lower than the $Ar_1$ point minus 200° C., then the rolled steel is heated to a temperature in the range defined by a value not higher than the $Ac_3$ point but one not lower than the $Ac_1$ point minus 100° C. using the heat resulting from rolling, and the steel then is cooled from that temperature down to 500° C. at a cooling rate not faster than 100° C./sec, alternatively the heated steel is either held for 7 minutes or longer in the temperature range of not higher than the $Ac_1$ point but not lower than 500° C., or the steel is subjected to repeated cycles of controlled rolling at a temperature not higher than $Ac_3$ but not lower than the $Ac_1$ point, both aiming at spheroidizing of cementite particles. Subsequently the steel is rolled to achieve a reduction in thickness of 15% or more, and heated to a temperature not lower than the $Ac_1$ point but not higher than the $Ac_3$ point by utilizing the heat of deformation. Either these techniques, however, involve the problems of increased surface defects and reduced durability of working rolls, since these methods obtain rolled soft steels by restricting the condition of hot rolling by means of effecting finish rolling at a lower temperature, in comparison with ordinary hot rolling which is usually finished at about 1,000° C.

As is well known, for example, Laid-Open Japanese Patent Publication No. 136421/1984 mentioned above, discloses that micro structures of steels as rolled vary somewhat depending on the kind of steel: steels of low hardenability have either pearlite or ferrite-pearlite structure, while alloy steels having high hardenability have bainite structure. Therefore, in order to reduce the strength of rolled steel, it is necessary to prevent the formation of bainite having high strength, to produce ferrite-pearlite structure and further to reduce the strength of the pearlite that accounts for the major part of the steel structure. In view of the generally established theory that the strength of pearlite is inversely proportional to the lamellar spacing of the cementite in the pearlite, the lamellar spacing must be widened if one wants to decrease the pearlite strength.

However, the lamellar spacing of cementite in the pearlite is solely determined by the temperature at which pearlite transformation from austenite takes place, and the higher the transformation point is, the more coarse the lamellar spacing of the cementite becomes. This means that in order to soften a rolled steel, transformation to pearlite must be done at high temperatures by either cooling the as-rolled steel slowly or by holding the as-rolled steel immediately after rolling at the highest possible temperature in the range wherein such pearlite transformation takes place. However, the rate at which the pearlite transformation proceeds decreases with increasing temperatures, and thus as excessively long period of time is required before the transformation is completed if the steel is transformed at higher temperatures. The problem is that whichever of the two softening methods is to be employed, the equipment or production line available today imposes inherent limitations with regard to the rate of slow cooling or to the period for which the rolled steel is maintained at the highest temperature that is practically possible.

The present inventors analyzed the aforementioned findings on the prior art and made various studies on the factors that would govern the properties in the strength of rolled machine structural steels. As a result, the inventors found that the two objectives, i.e. preventing formation of bainits having high strength together with an increase in the lamellar spacing of the cementite in pearlite, which is a very effective means for softening or reducing the strength of the medium carbon steel under conventional conditions of hot rolling and at the same time completing the pearlite transformation at a higher temperature in a shorter period of time which is also crucial to the purpose of softening the rolled steel, can be attained simultaneously by substituting Cr for a part of the Mn in the prior art steel and by employing appropriate conditions for cooling or holding the hot rolled steel after hot rolling. The present inventors have proposed a method which was accomplished on the basis of these findings and filed a patent application as Japanese Patent Application No. 13891/1985 filed on Jan. 28, 1985 and has been laid open on Aug. 6, 1986 as Laid-Open Japanese Patent Publication No. 174322/1986, and this invention corresponds to U.S. patent application Ser. No. 821,550. Although this method is very effective with respect to softening the rolled low alloy steels having low hardenability, there yet remains various rooms for improvement with respect to the softening of rolled alloy steels having a high extent of hardenability such as SCr or SCM steel.

SUMMARY OF THE INVENTION

The present invention has been conceived in view of the drawbacks mentioned above and aims to soften alloy steel of high hardenability in a hot rolled state.

The present invention has been accomplished on the novel concept that it is possible to promote pearlite transformation at elevated temperatures which is crucial state in the softening of rolled steel by means of boron (B) addition.

The present invention has been accomplished in view of the above-mentioned findings, the basic concept of which resides in that a method of directly softening a rolled machine structural steel is characterized by:

(1) hot rolling the steel containing from 0.2 to 0.65 wt% C, less than 0.1 wt% Si, 0.2 to 0.5 wt% Mn, 0.0003 to 0.01 wt% B, more than 0.5 to 1.7 wt% Cr, 0.01 to 0.1 wt% Al and at least one optional alloying element selected from either one of the group (A) consisting of not more than 1 wt% Ni, 0.1 to 0.5 wt% Mo and not more than 1 wt% Cu or the group (B) consisting of 0.002 to 0.05 wt% Ti, 0.005 to 0.05 wt% Nb and 0.005 to 0.2 wt% V or both of the groups (A) and (B) and the balance being Fe and incidental impurities; and (2) performing either one of the following softening treatments:

(i) slowly cooling the hot rolled steel, down to a temperature where transformation to pearlite is completed, at a cooling rate of not faster than 15° C./min; or (ii) immediately quenching the hot rolled steel to a temperature within the range of 680°–730° C. and holding the steel in this temperature range for a period of time until the pearlite transformation completes and air-cooling the steel.

DETAILED DESCRIPTION OF THE INVENTION

Figure 1:
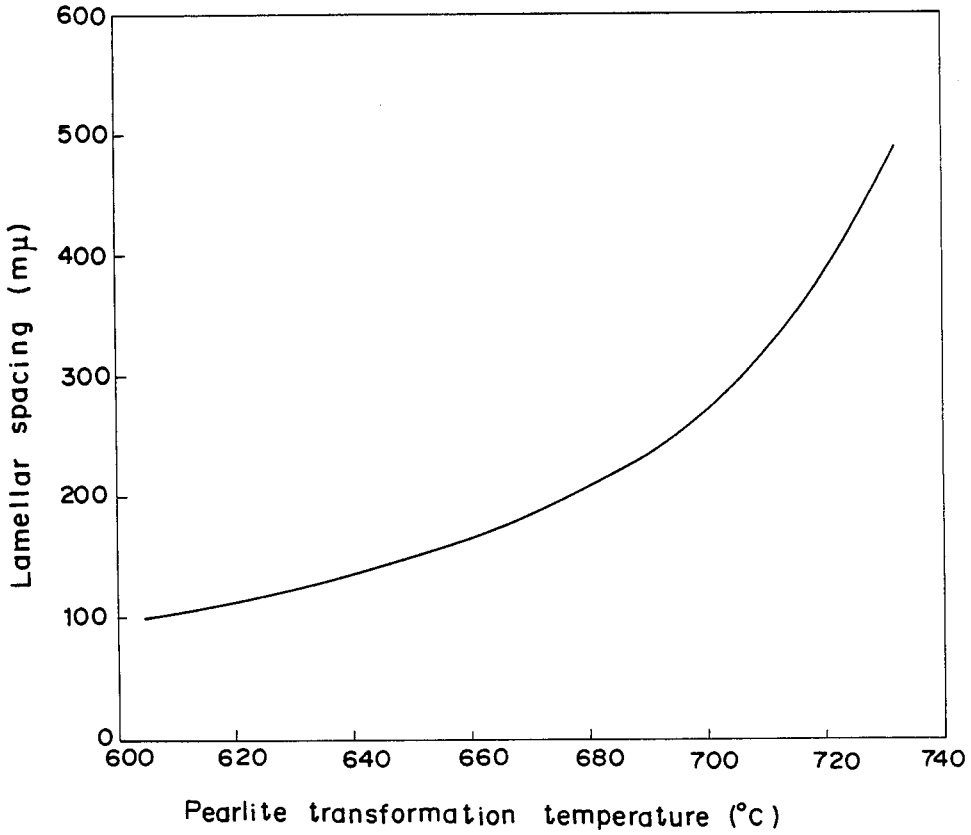
FIG. 1 is a graph showing an effect of pearlite transformation temperature on the lamellar spacing of the steel.

The term "softening" used herein means that the tensile strength of a rolled steel is lowered to a value not higher than $24+67\times Ceq$ (kg/mm$^2$) defined by the first formula:

The value of the tensile strength $\leqq 24+67\times Ceq$(kg/mm$^2$) wherein the value 24 depends on the strength of ferrite and pearlite;

the value 67 depends on the carbon equivalent Ceq., namely, the amount of pearlite;

the first formula was obtained by regression analysis by varying the carbon equivalent Ceq from 0.2 to 1.2%;

the carbon equivalent Ceq is expressed by the second formula:

$$Ceq=C+Si/24+Mn/6+Cr/5+Mo/4+Cu/13+Ni/40,$$

wherein values of C, Si, Mn, Cr, Mo, Cu and Ni in the second formula correspond to weight percents of components of the rolled steel.

Accordingly, the rolled steel cannot be considered to have been softened if its tensile strength exceeds the value obtained from the first formula.

The criticality of each of the components of the steel to be treated by the method of the present invention and that of the respective range of the amount of each element are described hereinafter.

To begin with, carbon (C) is an element essential for providing the cold forged product with necessary strength by subsequent quenching and tempering. If the C content is less than 0.2%, necessary strength is not obtained, while if the C content exceeds 0.65%, no corresponding increase in strength can be attained by subsequent quenching or tempering.

Therefore, the C content is limited to the range of 0.20–0.65%.

Silicon (Si) is effective as a deoxidizing agent, but it has a solid solution hardening effect and is deleterious to the purpose of the present invention, since it will increase the strength of the rolled steel. Therefore, the Si content is limited to less than 0.1% at which content its solid solution hardening effect becomes negligible. Preferably, Si content shall be limited to less than 0.05%.

The most important aspect of the present invention lies in the addition of Mn and B in amounts as specified above. The Japanese Industrial Standards (JIS) specifies that SCr 435, typical prior art machine structural steels, must contain 0.42 to 0.48% C, 0.15–0.35% Si, 0.60–0.85% Mn and 0.90–1.20% Cr.

By decreasing the Mn content to a lower level, the temperature at which the transformation to pearlite ends and that is a crucial point for softening rolled steel can be raised as compared with SCr 435 steel. Similarly, boron (B) has an effect for accelerating pearlite transformation, due to the fact that boron in solid solution is apt to precipitate as borides rather than to suppress pearlite transformation, provided that the steel is slowly cooled or held at a high temperature. This means that a boron-added steel will complete transformation to a pearlite in a shorter period of time if the steel is slowly cooled or held at a high temperature after having been hot rolled.

Generally, boron is used as an alloying element for improving hardenability, but boron in the present invention is used for both accelerating the transformation to pearlite subsequent to hot rolling and improving hardenability when the steel is heat-treated subsequent to cold forging.

Table 1 shows, as an example, the effect of Mn and B on the temperature at the end point of pearlite transformation, the lamellar spacing and the strength of the rolled steel.

The end point of pearlite transformation of the steel of the present invention, with reduced Mn content and added B content, is shifted to a higher temperature as compared with ordinary SCr435 steel by above 40° C., thereby the lamellar spacing of the cementite is rendered roughly to a value of above 200 mμ which greatly contributes to the softening of rolled steel.

In addition, the temperature at which this steel transforms to pearlite is shifted to the high temperature side, due to reducing the Mn content and raising the B content, so the transformation to pearlite can be completed within a shorter period of time as compared with currently used steel even if the steel as rolled is held at a temperature close to the $Ar_1$ point.

TABLE 1

| Kind of Steel | Chemical composition (wt %) C | Si | Mn | Cr | Al | B | P | S | End point of pearlite transformation (°C.)*1 | Lamellar spacing (mμ) | Strength of rolled steel (kg/mm²) |
|---|---|---|---|---|---|---|---|---|---|---|---|
| Steel for comparison | 0.34 | 0.26 | 0.74 | 1.03 | 0.036 | — | 0.016 | 0.008 | 654 | 152 | 71.5 |
| Inventive steel | 0.35 | 0.03 | 0.31 | 1.07 | 0.047 | 0.0023 | 0.014 | 0.009 | 697 | 273 | 57.1 |

Cooling rate after hot rolling: 7° C./min.
*1: End point of pearlite transformation was measured by dilatometer.

The reason why the amounts of Mn and B are limited as explained above will be mentioned hereafter.

In order to ensure rapid completion of the transformation to pearlite in the high temperature region, it is preferable for the Mn to be reduced to as low a level as possible. However, if the Mn content is reduced to less than 0.2%, the sulfur in the steel cannot be sufficiently fixed to prevent hot brittleness. If, on the other hand, the Mn content exceeds 0.5%, the addition of B becomes ineffective for the purpose of ensuring rapid completion of the transformation to pearlite at elevated temperatures. Therefore, the Mn content is limited to the range of 0.2–0.5%.

Although B is an effective element for accelerating transformation to pearlite for softening the rolled steel and for enhancing hardenability obtained by heat-treatment after cold forging, thereby improving strength of the steel, it is ineffective if the added amount is less than 0.0003%, while it deteriorates cold forgeability when it exceeds 0.01%, so the acceptable range was set to 0.0003% to 0.01%.

Chromium (Cr) is an element essential for the purpose of enhancing hardenability obtained by heat-treatment after cold forging and thereby improving strength and toughness, but if the Cr content is less than 0.5%, this effect cannot be achieved and such the alloy steel cannot be regarded as an alloy steel of high hardenability aimed by the present invention. If, on the other hand, the Cr content exceeds 1.7%, the hardenability of the steel is excessively increased so as to lower the end point of transformation to pearlite whereby the steel cannot be used for rolled soft steel. Therefore, the Cr content is limited to the range of 0.5–1.7%.

Aluminum is an indispensable element for preventing coarsening of austenite grains when the cold forged product is quenched and at the same time for fixing N as an AlN compound in order to ensure the boron-effect of accelerating pearlite transformation and hardenability, however, if the Al content is less than 0.01%, it is ineffective, while if it exceeds 0.1%, the above-mentioned effects saturate. Therefore, the acceptable amount of Al is set at 0.01–0.1%.

While the essential constituents of the steel to be treated in accordance with the present invention have been described above, the steel may optionally contain one or more series of element (A) of at least one element selected from the group consisting of not more than 1% Ni, 0.1–0.5% Mo and not more than 1% Cu; or (B) of at least one element selected from the group consisting of 0.002–0.05% Ti, 0.005–0.05% Nb and 0.005–0.2% V.

Nickel is added for the purpose of improving not only the toughness of the steel but also its hardenability, and hence its strength. The upper limit of the Ni content is set 1%, above which the hardenability of the steel is excessively increased as to cause harmful effects on its cold forgeability.

Molybdenum provides improved hardenability and exhibits high resistance against the softening of the steel upon tempering. The effect of Mo is insufficient if the amount is less than 0.1% and the upper limit of Mo content is 0.5%, since no commensurate advantage will result if more than 0.5% Mo is used. Therefore, the Mo content is limited to the range of 0.1–0.5%.

Copper is also effective, similar to Ni, in improving the toughness and hardenability of the steel, but the upper limit of its content is again set at 1%, above which point the effectiveness of Cu does not increase.

On the other hand, each of Ti, Nb and V, belonging to series (B), is added for the purpose of refining the austenite grain size of the steel after hot rolling and for accelerating the transformation to pearlite at elevated temperature tange.

Ti combines with N to form TiN and thereby it prevents austenite grains from coarsening after hot rolling and it accelerates pearlite transformation an elevated temperature range. It is more effective to use Ti in combination with B than when they are added separately; Ti is added to fix N together with Al, thereby maximizing the capability of B to accelerate pearlite transformation after hot rolling as well as to increase hardenability after cold forging.

If the Ti content is less than 0.002%, the desired N-fixing effect is not obtained. If, on the other hand, the Ti content exceeds 0.05%, coarse and harmful TiN or TiC will form which reduce both the cold forgeability and toughness of the steel. Therefore, the Ti content is limited to the range of 0.002–0.05%.

Each of Nb and V is added for the purpose of accelerating the transformation to pearlite by refining on the austenite grains in the rolled steel, but no such refining effect is attained if the content of each element is less than 0.05%. If the contents of Nb and V exceed 0.05% and 0.2%, respectively, coarse carbonitrides of Nb and V will precipitate, leading to deteriolation in toughness and cold forgeability. Therefore, the Nb and V contents are limited to the ranges of 0.005–0.05% and 0.005–0.2%, respectively.

In accordance with the present invention, the hot rolled product of the steel defined above is subjected to one of the following softening treatments:

(i) slowly cooling the rolled steel in a temperature range after hot rolling until transformation to pearlite is completed at a cooling rate of lower than 15° C./min, or (ii) immediately quenching the rolled steel to a temperature within the range of 680°–730° C., holding the steel in this temperature range for a period of time, until the pearlite transformation terminates, and air-cooling the steel. Whichever method is employed, transformation to pearlite in the high temperature range can be completed within a short period of time and the spacing of lamellar cementite is made wider than 200 mμ so that the steel can display a tensile strength not greater than $24+67\times Ceq$ (kg/mm$^2$).

In the first method (i), the hot-rolled steel is slowly cooled at a rate of not faster than 15° C./min because if the cooling rate is faster than 15° C./min, the temperature at which transformation to pearlite starts is shifted down and bainite having strength higher than pearlite can form, which makes it impossible to attain the devised objective of softening the rolled steel of the present invention.

It is true that the slower the cooling rate, the better the results that are obtained; but the preferable rate is to be selected within the range of 3°–10° C./min for satisfying both the softening of the product and the equipment and the production line in practical use. The hot-rolled steel may be immediately cooled slowly at a cooling rate specified above, but for the given composition of the present invention, satisfactory results will be obtained even if the slow cooling is conducted from about 750° C. As for the termination of slow cooling, it should be continued until transformation to pearlite is completed because, if it is stopped too early, pearlite or bainite will form as a result of low-temperature transformation during the subsequent air-cooling step which gives rise to an undesirably hard product.

Alternatively, the hot-rolled steel may be softened by employing the second method (ii), wherein the steel can be softened if it is immediately quenched to a temperature within the range of 680°–730° C., and subsequently held in this temperature range until the pearlite transformation finishes. The upper limit of the holding temperature is set to be 730° C., because if it is higher than 730° C., an impracticably long period is necessary for completing transformation to pearlite.

It was decided that the lower limit of the holding temperature is 680° C., because if it is lower than 680° C., the lamellar spacing of cementite becomes too fine and, as a result, the strength of the pearlite phase is so much increased that the desired soft product will not be obtained. The holding time is set to be until the time when the transformation to pearlite is completed, because if holding is not continued until the completion of transformation, perlite or bainite will form through low temperature transformation accompanying hardening of the product during the subsequent air-cooling step. The higher the holding temperature of the steel, the larger the extent of softening of steel obtainable, however it will require a longer period of time until the completion of transformation.

In view of this, preferable holding temperature for both producibility and softening of the steel product was set at a range of 690°–710° C.

Subsequent to the holding operation, the steel is air-cooled, because transformation to pearlite has been completed by the preceding holding step and any further slow cooling is not needed at all.

Either of the two softening methods (i) and (ii) can obtain the desired lamellar spacing of cementite grains in pearlite phase above 200 mμ as shown in FIG. 1, as long as the chemical composition of the steel is maintained within the specified limit in accordance with the present invention.

Though no particular condition are specified for the finishing temperature of hot rolling of the present invention, since it is preferable to make the ferrite grain size as rough as practically possible, a finishing temperature lower than 900° C. is to be avoided.

The meritorious effects of the invention will be explained hereafter by referring to the Example.

EXAMPLE

Steel samples having the chemical compositions shown in Table 2 were hot-rolled to bars of 13 in diameter under normal conditions of hot-rolling and were subjected to subsequent cooling also shown in the same Table.

Sample Nos. 4, 5, 10–17, 23–25, 27–29 were those prepared in accordance with the present invention, and the other samples were prepared for comparison. The treated samples were checked for their tensile strength by using JIS 14A standard specimens, while each of those for evaluating cold forgeability were machined as a bar having 10 $\phi$mm×15 mm length formed with a V notch of 0.5 mm depth and was subjected to a compression test under an upsetting ratio of 40% to observe whether any cracks were formed or not. The samples in which no cracks were found are marked with ○ (good), while those which developed a crack or cracks were marked x (poor). The results of these tests are also shown in Table 2. As can be clearly seen from Table 2, the samples of rolled steel prepared and treated in accordance with the present invention revealed that they all had satisfactory tensile strength value well below $24+67\times Ceq$ (kg/mm$^2$) together with satisfactory cold forgeability.

On the other hand, comparative sample No. 1 showed too high a strength value due to high contents of Mn and Si and absence of boron. Sample Nos. 2 and 9, the former due to a high amount of Si and low amount of B, and the latter due to large amount of Cr, were not softened below the desired value of $24+67\times Ceq$ (kg/mm$^2$). The sample No. 3, owing to its high Si content and excessive cooling rate after rolling, revealed both excessively high strength and poor cold forgeability.

Sample No. 6, owing to its low Al content, was not able to attain the desired softening.

Sample Nos. 7, 8, 22 and 26 were not able to attain the desired softening, due to undesirable conditions either in cooling after hot rolling or in isothermal holding after hot rolling.

In more detail, sample No. 22 failed in the desired object of softening due to excessive cooling rate subsequent to rolling, while sample Nos. 8 and 26 failed in the desired object due to the fact that they were held at an adversely lower temperature. Since sample No. 7 was held at too high a temperature after rolling, transformation of this sample to pearlite did not perfectly end even after it had been held for 55 minutes and thus showed excessive strength.

Although both steel samples of Nos. 18 and 19, were able to satisfy the required level of softening, they were not able to satisfy the requirement of cold forgeability, due to their high content of B and Ti, respectively.

Sample No. 20 was too high in strength due to its excessive content of both Si and Mn and further had poor cold forgeability brought about by an excessive amount of Nb. Sample No. 21 was able to meet the required softening level, but proved to be poor in cold forgeability due to its large amount of V.

TABLE 2

| Sample No. | Chemical Composition (wt %) | | | | | | | | | | | | | |
|---|---|---|---|---|---|---|---|---|---|---|---|---|---|---|
| | C | Si | Mn | B | Cr | Al | P | S | Ni | Mo | Cu | Ti | Nb | V |
| 1 | 0.34 | 0.19 | 0.78 | — | 1.15 | 0.036 | 0.016 | 0.010 | — | — | — | — | — | — |
| 2 | 0.44 | 0.18 | 0.41 | 0.0002 | 0.81 | 0.041 | 0.019 | 0.012 | — | — | — | — | — | — |
| 3 | 0.48 | 0.16 | 0.45 | 0.0022 | 1.21 | 0.058 | 0.017 | 0.008 | — | — | — | — | — | — |
| 4 | 0.52 | 0.05 | 0.36 | 0.0054 | 0.59 | 0.079 | 0.017 | 0.015 | — | — | — | — | — | — |
| 5 | 0.32 | 0.05 | 0.29 | 0.0021 | 1.21 | 0.048 | 0.017 | 0.006 | — | 0.21 | — | — | — | — |
| 6 | 0.25 | 0.04 | 0.32 | 0.0017 | 1.16 | 0.004 | 0.012 | 0.008 | — | — | — | — | — | — |
| 7 | 0.33 | 0.08 | 0.29 | 0.0031 | 0.89 | 0.058 | 0.015 | 0.011 | — | — | — | — | — | — |
| 8 | 0.33 | 0.08 | 0.29 | 0.0031 | 0.89 | 0.058 | 0.015 | 0.011 | — | — | — | — | — | — |
| 9 | 0.32 | 0.05 | 0.41 | 0.0023 | 1.86 | 0.071 | 0.019 | 0.002 | — | — | — | — | — | — |
| 10 | 0.32 | 0.05 | 0.34 | 0.0025 | 1.18 | 0.061 | 0.012 | 0.007 | — | — | — | 0.008 | — | — |
| 11 | 0.33 | 0.07 | 0.29 | 0.0031 | 1.32 | 0.052 | 0.015 | 0.008 | — | — | — | 0.010 | 0.012 | — |
| 12 | 0.43 | 0.01 | 0.27 | 0.0026 | 1.21 | 0.055 | 0.015 | 0.008 | — | — | — | — | 0.015 | — |
| 13 | 0.32 | 0.05 | 0.34 | 0.0025 | 1.18 | 0.061 | 0.012 | 0.007 | — | 0.19 | — | 0.041 | — | — |
| 14 | 0.33 | 0.07 | 0.29 | 0.0031 | 1.32 | 0.052 | 0.015 | 0.009 | — | — | — | 0.010 | 0.024 | — |
| 15 | 0.48 | 0.09 | 0.39 | 0.0029 | 0.61 | 0.068 | 0.014 | 0.004 | — | 0.21 | 0.13 | — | — | 0.09 |
| 16 | 0.48 | 0.09 | 0.39 | 0.0029 | 0.61 | 0.068 | 0.014 | 0.004 | — | 0.21 | 0.13 | — | — | 0.09 |
| 17 | 0.35 | 0.03 | 0.32 | 0.0074 | 0.76 | 0.079 | 0.012 | 0.003 | — | 0.35 | — | — | 0.018 | — |
| 18 | 0.44 | 0.08 | 0.31 | 0.0115 | 0.57 | 0.087 | 0.015 | 0.009 | — | — | — | — | — | — |
| 19 | 0.35 | 0.07 | 0.41 | 0.0056 | 0.61 | 0.081 | 0.019 | 0.015 | 0.16 | — | — | 0.061 | — | — |
| 20 | 0.25 | 0.31 | 0.75 | 0.0029 | 1.31 | 0.063 | 0.019 | 0.015 | — | — | 0.11 | — | 0.059 | — |
| 21 | 0.31 | 0.09 | 0.37 | 0.0015 | 0.98 | 0.061 | 0.017 | 0.016 | — | — | — | — | — | 0.26 |
| 22 | 0.34 | 0.09 | 0.27 | 0.0043 | 1.56 | 0.076 | 0.012 | 0.010 | — | 0.34 | — | — | — | — |
| 23 | 0.29 | 0.05 | 0.31 | 0.0011 | 1.24 | 0.021 | 0.017 | 0.019 | — | 0.27 | — | 0.014 | — | — |
| 24 | 0.32 | 0.01 | 0.30 | 0.0017 | 1.04 | 0.031 | 0.015 | 0.013 | — | 0.19 | — | 0.009 | 0.017 | — |
| 25 | 0.32 | 0.01 | 0.30 | 0.0017 | 1.04 | 0.031 | 0.015 | 0.013 | — | 0.19 | — | 0.009 | 0.017 | — |
| 26 | 0.32 | 0.01 | 0.30 | 0.0017 | 1.04 | 0.031 | 0.015 | 0.013 | — | 0.19 | — | 0.009 | 0.017 | — |
| 27 | 0.23 | 0.04 | 0.32 | 0.0020 | 1.66 | 0.021 | 0.017 | 0.018 | 0.15 | — | — | — | — | — |
| 28 | 0.27 | 0.02 | 0.25 | 0.0014 | 0.78 | 0.051 | 0.014 | 0.005 | — | 0.22 | 0.14 | 0.011 | 0.014 | — |
| 29 | 0.35 | 0.03 | 0.31 | 0.0023 | 1.07 | 0.047 | 0.014 | 0.009 | — | — | — | — | — | — |

| Sample No. | Cooling rate after hot rolling (°C./min.)*1 | Holding after hot rolling*2 temp.(°C.) | Holding after hot rolling*2 Time(min.) | 24 + 67 × Ceq (kg/mm²) | Strength of rolled steel (kg/mm²) | Cold forgeability |
|---|---|---|---|---|---|---|
| 1 | 9 | — | — | 71.4 | 73.1 | ○ |
| 2 | 10 | — | — | 69.4 | 71.5 | ○ |
| 3 | 16 | — | — | 77.8 | 79.5 | × |
| 4 | — | 725 | 60 | 70.9 | 61.1 | ○ |
| 5 | 7 | — | — | 68.5 | 60.5 | ○ |
| 6 | 8 | — | — | 60.0 | 61.2 | ○ |
| 6 | — | 735 | 55 | 61.5 | 75.2 | ○ |
| 8 | — | 670 | 40 | 61.5 | 65.6 | ○ |
| 9 | 12 | — | — | 75.1 | 77.9 | ○ |
| 10 | 5 | — | — | 65.2 | 55.4 | ○ |
| 11 | 8 | — | — | 67.2 | 60.6 | ○ |
| 12 | 11 | — | — | 72.1 | 69.8 | ○ |
| 13 | — | 690 | 40 | 68.4 | 60.4 | ○ |
| 14 | — | 695 | 50 | 67.2 | 58.1 | ○ |
| 15 | 6 | — | — | 73.1 | 64.3 | ○ |
| 16 | — | 680 | 20 | 73.1 | 67.6 | ○ |
| 17 | 6 | — | — | 67.2 | 56.8 | ○ |
| 18 | — | 710 | 45 | 64.8 | 55.9 | × |
| 19 | — | 690 | 30 | 60.7 | 53.4 | × |
| 20 | 4 | — | — | 68.1 | 71.6 | × |
| 21 | 7 | — | — | 62.3 | 55.2 | × |
| 22 | 18 | — | — | 76.6 | 80.5 | × |
| 23 | 4 | — | — | 68.2 | 58.7 | |
| 24 | 6 | — | — | 65.9 | 57.1 | ○ |
| 25 | — | 700 | 45 | 65.9 | 56.0 | ○ |
| 26 | — | 665 | 40 | 65.9 | 71.3 | ○ |
| 27 | 7 | — | — | 65.6 | 56.5 | ○ |
| 28 | — | 700 | 30 | 59.8 | 50.3 | ○ |
| 29 | 7 | — | — | 65.3 | 57.1 | ○ |

*1: Cooling rate when the sample is continuously cooled after rolling.
*2: Temperature and time of holding when the samples were isothermally held immediately after rolling.

As can be clearly understood from the Examples explained above, the present invention has enabled production of machine structural steel which, in its as-rolled state, has both the softness and cold forgeability at the same degree as those given by other conventional spheroidized steel. This is achieved by means of selectting an optimum composition range, provided that the pearlite transformation is permitted to terminate at an elevated temperature range, and it is combined with an ordinary cooling rate subsequent to hot rolling without imposing any particular condition for finish rolling. Accordingly, the present invention can greatly contribute to the steel making industry.

What is claimed is:

1. A method of directly softening a rolled machine structural steel, which comprises the steps of:

hot rolling a steel consisting essentially of 0.2–0.65% C, less than 0.1% Si, 0.2–0.5% Mn, 0.0003–0.01% B, more than 0.5–1.7% Cr, 0.01–0.1% Al, all of the percentages being on a weight basis, and the balance being Fe and incidental impurities, and subjecting said as-rolled steel to a softening treatment which comprises slowly cooling the steel in a temperature range until transformation to pearlite is completed at a cooling rate of less than 15° C./min, so that the steel can display a tensile strength less than a value expressed by a formula, $24+67\times Ceq$ ($kg/mm^2$), specified by the carbon equivalent Ceq ($kg/mm^2$) of the subject steel.

2. A method of directly softening a rolled machine structural steel, which comprises the steps of:

hot rolling a steel consisting essentially of 0.2–0.65% C, less than 0.1% Si, 0.2–0.5% Mn, 0.0003–0.01% B, more than 0.5 and up to 1.7% Cr, 0.01–0.1% Al, all of the percentages being on a weight basis, and the balance being Fe and incidental impurities, and immediately after said hot rolling subjecting the steel to a softening treatment which comprises isothermally holding said steel in a temperature range of 680° to 730° C. until transformation to pearlite is completed and then to natural cooling, so that the steel can display tensile strength less than a value expressed by the formula $24+67\times Ceq$ ($kg/mm^2$), specified by the carbon equivalent Ceq ($kg/mm^2$) of the subject steel.

3. A method of directly softening a rolled machine structural steel as claimed in claim 1, wherein said steel further contains at least one element selected from the group consisting of not more than 1% Ni, 0.1–0.5% Mo and not more than 1% Cu.

4. A method of directly softening a rolled machine structural steel as claimed in claim 1, wherein said steel further contains at least one element selected from the group consisting of 0.002–0.05% Ti, 0.005–0.05% Nb and 0.005–0.2% V.

5. A method of directly softening a rolled machine structural steel as claimed in claim 1, wherein said steel further contains at least one element selected from the group consisting of not more than 1% Ni, 0.1–0.5% Mo and not more than 1% Cu, and at least one element selected from the group consisting of 0.002–0.05% Ti, 0.005–0.05% Nb and 0.005–0.2% V.

6. A method of directly softening a rolled machine structural steel as claimed in claim 2, wherein said steel further contains at least one element selected from the group consisting of not more than 1% Ni, 0.1–0.5% Mo and not more than 1% Cu.

7. A method of directly softening a rolled machine structural steel as claimed in claim 2, wherein said steel further contains at least one element selected from the group consisting of 0.002–0.05% Ti, 0.005–0.05% Nb and 0.005–0.2% V.

8. A method of directly softening a rolled machine structural steel as claimed in claim 2, wherein said steel further contains at least one element selected from the group consisting of not more than 1% Ni, 0.1–0.5% Mo and not more than 1% Cu, and at least one element selected from the other group consisting of 0.002–0.05% Ti, 0.005–0.05% Nb and 0.005–0.2% V.

* * * * *